US009263827B2

(12) United States Patent
Leroyer et al.

(10) Patent No.: US 9,263,827 B2
(45) Date of Patent: Feb. 16, 2016

(54) SYSTEM FOR CONNECTING A CONNECTOR BASE ONTO AN ELECTRONICS UNIT AND PROCESS FOR MOUNTING THIS SYSTEM

(71) Applicant: SOURIAU, Versailles (FR)

(72) Inventors: Serge Leroyer, Le Mans (FR); Pascal Ribeau, Le Mans (FR); Yann Blavette, Spay (FR)

(73) Assignee: SOURIAU, Versailles (FR)

( * ) Notice: Subject to any disclaimer, the term of this patent is extended or adjusted under 35 U.S.C. 154(b) by 0 days.

(21) Appl. No.: 14/072,827

(22) Filed: Nov. 6, 2013

(65) Prior Publication Data

US 2014/0127936 A1 May 8, 2014

(30) Foreign Application Priority Data

Nov. 6, 2012 (FR) ..... 12 60546

(51) Int. Cl.

| | |
|---|---|
| ***H01R 13/60*** | (2006.01) |
| ***H01R 12/70*** | (2011.01) |
| *H01R 12/58* | (2011.01) |
| *H01R 13/502* | (2006.01) |
| *H01R 13/74* | (2006.01) |

(52) U.S. Cl.

CPC ..... *H01R 13/60* (2013.01); *H01R 12/7052* (2013.01); *H01R 12/58* (2013.01); *H01R 13/502* (2013.01); *H01R 13/74* (2013.01); *Y10T 29/49204* (2015.01)

(58) Field of Classification Search

USPC ..... 439/527, 79, 660, 637, 670

See application file for complete search history.

(56) References Cited

U.S. PATENT DOCUMENTS

| | | | | |
|---|---|---|---|---|
| 5,108,311 | A * | 4/1992 | Nakazawa | 439/607.32 |
| 6,482,045 | B2 * | 11/2002 | Arai | 439/680 |
| 7,326,063 | B1 | 2/2008 | Raudenbush et al. | |
| 8,376,783 | B2 * | 2/2013 | Kondo et al. | 439/660 |
| 2007/0099512 | A1 * | 5/2007 | Sato | 439/637 |
| 2013/0137310 | A1 * | 5/2013 | Genau | 439/660 |

FOREIGN PATENT DOCUMENTS

| | | |
|---|---|---|
| DE | 296 05 985 U1 | 6/1996 |
| DE | 10 2010 051954 B3 | 2/2012 |

OTHER PUBLICATIONS

French Search Report, dated Jun. 12, 2013, from corresponding French application.

* cited by examiner

*Primary Examiner* — Alexander Gilman
(74) *Attorney, Agent, or Firm* — Young & Thompson

(57) ABSTRACT

A connection system includes a base (20) that can be mounted through a wall (11) of an electronics unit (10), the base (20) being provided with electric pin contacts (24) that come out into the electronics unit and whose ends are connected electrically to a printed circuit (50) of the electronics unit. This base (20) is equipped with a holding plate (40), mounted around electric pin contacts (24) and around a back part (21) of the base and, provided with catch elements (42) that can be fitted into the printed circuit, so that the base is integral with the printed circuit.

9 Claims, 3 Drawing Sheets

SYSTEM FOR CONNECTING A CONNECTOR BASE ONTO AN ELECTRONICS UNIT AND PROCESS FOR MOUNTING THIS SYSTEM

FIELD OF THE INVENTION

The invention relates to a connection system that makes it possible for a base with pins to be mounted in an electronics unit wall without relative rotation between the base and a printed circuit of the electronics unit. This connection system comprises a holding plate, integral with both the base and the printed circuit. The invention also relates to a process for mounting this system.

The invention has applications in numerous technical fields where an electronic system must be connected to a piece of electrical equipment. In particular, it has applications in the field of telecommunications, aeronautics, the automobile, and in all fields where an electrical connector base must be connected to an electronics unit.

PRIOR ART

In certain fields, such as those of aeronautics and the automobile, it can be necessary to connect an electronic system to a piece of electrical equipment. An electronics unit equipped with one or more printed circuit(s) must then be connected to one or more electrical connectors. To do this, it is known to connect the electric contacts of the base of the connector with a printed circuit by soldering said electric contacts on said printed circuit.

Once the printed circuit is welded, the front part of the base of the connector is mounted through the wall of the electronics unit. To do this, the front part of the base of the connector is introduced into an orifice of the wall, the back end of the base remaining inside the electronics unit.

The part of the base intended to receive a complementary connector plug is called "front part" of the base, and the part of the base intended to remain inside the electronics unit is called "back part" or "back end" of the base.

FIG. 1 shows a standard base that can be used with the system of the invention. This base, referenced 20, is a base with pins, i.e., a base equipped with electric contacts whose back part will become lodged in holes of printed circuits. This base has a front part 22, a back part 21 and an inner wall 23. The electric contacts 24, more simply called pin contacts, pass through the base 20. In the front part 22 of the base, the pin contacts 24 are intended to be joined to contacts of a complementary connector plug, not shown in the figure. In the back part 21 of the base 20, the pin contacts are projecting so as to be connected by welding to a printed circuit, also called PCB (Printed Circuit Board, in English). The back part 21 of the base has a crenellated end 26 that makes possible a support connection on the PCB to control the position of said PCB along the longitudinal axis. Also, these crenels 26 are made from the same material as the unit, which can cause drawbacks from the standpoint of the electrical conduction (insulating or conductive materials).

The front part 22 of the base is generally provided with a threading 25 over its entire outer surface. Thus, when the front part 22 of the base is installed through the wall of the electronics unit, a nut 30 can be screwed around this front part 22 until the wall of the electronics unit is tightened. In this way, the wall is held between the nut 30 and the inner wall 23 of the base.

In FIGS. 2 and 3, there is shown diagrammatically an example of a base of FIG. 1 mounted in the wall 11 of an electronics unit 10. In FIG. 3, the front part 22 of the base 20 coming out of an orifice 12 made in the wall 11 is seen. Also seen is a nut 30 that can be screwed around this front part 22. In FIG. 2, the front part 22 of the base is shown surrounded by the nut 30.

In this FIG. 3, the back part 21 has been shown with the pin contacts 24 and the inner wall 23 mounted on the wall 11. As this FIG. 3 shows, the base is held through the wall 11 by the inner wall 23 and by the nut 30, which are facing each other on both sides of said wall.

However, at the end of the tightening of the nut 30 against the wall 11, the base 20 is carried along by the nut. It therefore undergoes a relative movement of rotation in relation to the printed circuit. Actually, during the tightening of the nut against the wall, the movement of rotation performed by the operator on the nut causes a movement of the base inside the wall. This movement of the base in relation to the wall causes a movement relative to the printed circuit, which produces a relative play between the printed circuit and the pin contacts. This relative play has the effect of creating failures of connection at the welds between the pin contacts and the printed circuit.

DISCLOSURE OF THE INVENTION

The invention has precisely as its object to eliminate the drawbacks of the previously explained techniques. For this purpose, the invention proposes a connection system comprising a holding plate mounted on the base and housed partially in the printed circuit. This holding plate makes it possible to make the base integral with the printed circuit by the holding plate preventing any relative movement between the base and the printed circuit.

More specifically, the invention relates to a connection system comprising a base that can be mounted through a wall of an electronics unit, said base being provided with electric pin contacts that come out into the electronics unit and whose ends are connected electrically to a printed circuit of said electronics unit. This system is characterized by the fact that the base is equipped with a holding plate, on the one hand, mounted around the electric pin contacts and around a back part of the base and, on the other hand, provided with catch means that can be fitted into the printed circuit. In this way, the base is made integral with the printed circuit, which prevents any relative movement of rotation between the base and the printed circuit.

This connection system can comprise one or more of the following characteristics:

- the holding plate exhibits a cylindrical shape with dimensions suitable for the contour of the back part of the base.
- the holding plate comprises, on an inner cylindrical wall, orientation notches that can prevent any relative movement of rotation between the holding plate and the base. In this way, the holding plate is rendered integral with the base.
- the catch means comprise at least two studs that are distributed on a circular face of the holding plate and that can be lodged in the printed circuit. In this way, the holding plate is rendered integral with the printed circuit.
- the holding plate is made by molding a thermoplastic material if an electrical insulation between the base and the PCB must be ensured.
- the system comprises a nut that can be screwed around a front part of the base and that can be tightened against the wall of the electronics unit.

The invention also relates to a process for mounting a connection system as described above. This process is characterized by the fact that it comprises the following operations:

- mounting the holding plate around the back part of the base,
- mounting the electric pin contacts of the base and of the catch means of the holding plate in the printed circuit,
- connection of the electric pin contacts on the printed circuit,
- mounting the front part of the base in an orifice of the wall of the electronics unit,
- screwing a nut around the front part of the base until the wall is tightened.

Thus mounted, no movement of rotation that is generated by the nut and that carries along the base can have an effect on the connections between the pin contacts and the printed circuit.

DETAILED DESCRIPTION OF EMBODIMENTS OF THE INVENTION

The invention relates to a connection system that makes it possible to mount a standard base in a wall of an electronics unit without there being play between the base and the printed circuit to which the pin contacts of the base are connected.

Figure 1:
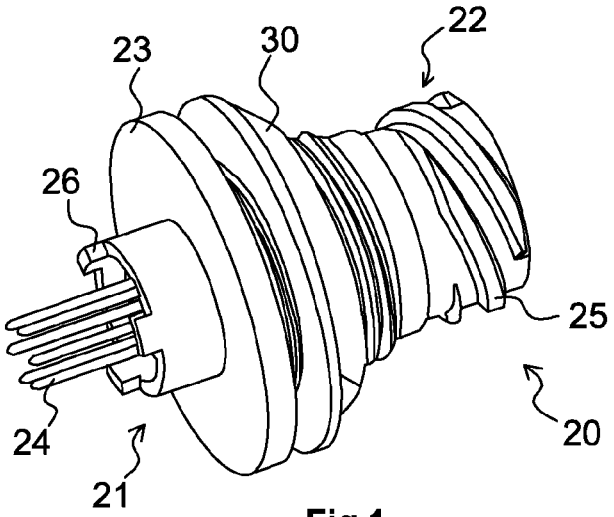
FIG. 1 shows a perspective view of a standard base routinely used for connections on electronics units.
Figure 3:
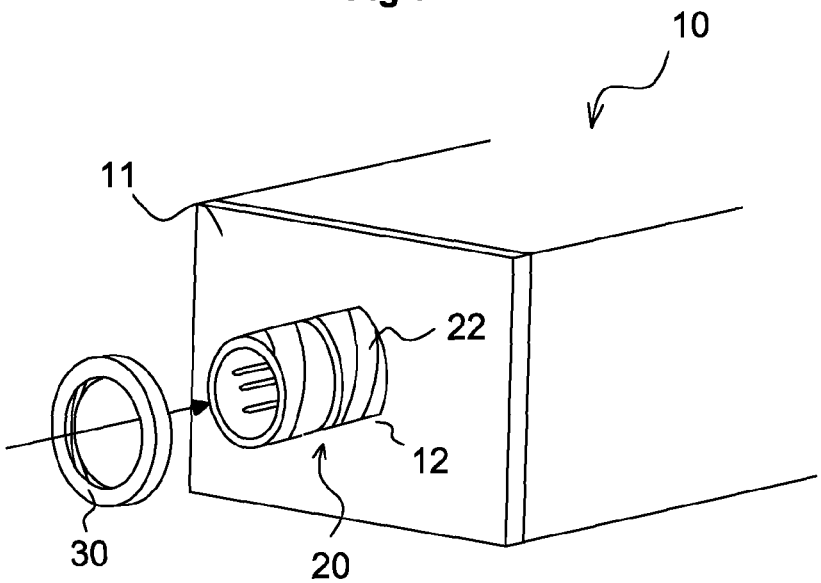
FIG. 3 shows an exploded view of a standard base and of a nut during the installation of the base in a wall.
Figure 2:
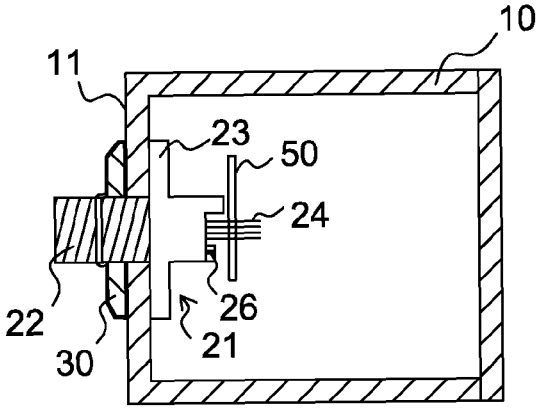
FIG. 2 shows a side view of a standard base mounted in the wall of an electronics unit according to a standard connection system.
Figure 4:
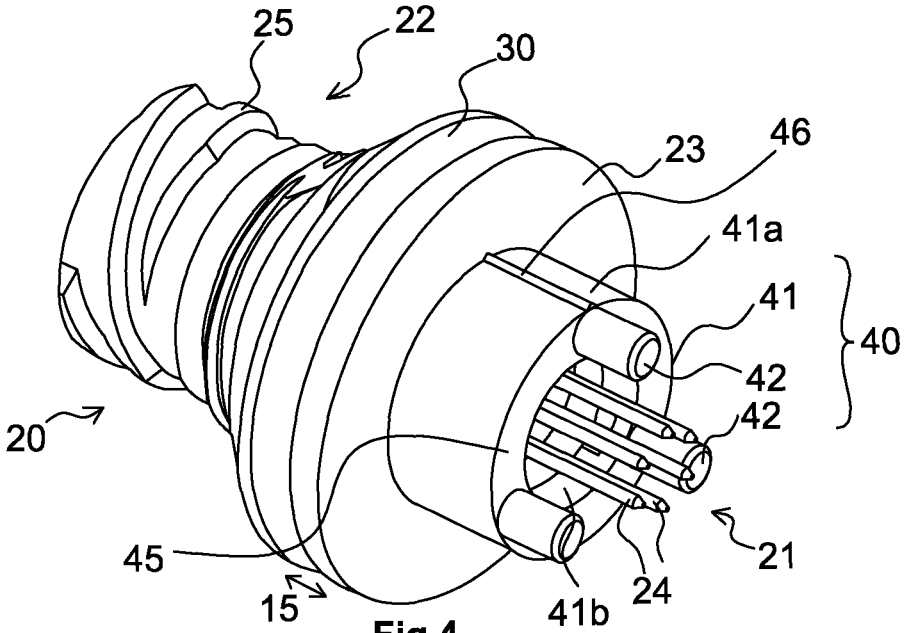
FIG. 4 shows a perspective view of a connection system according to the invention with a standard base and a holding plate.

FIG. 4 shows a standard base as shown in FIG. 1 with a holding plate according to the invention. In this FIG. 4, as well as in the following FIGS. 5A and 5B, the wall of the electronics unit is not shown as a measure of simplifying said figure.

As shown in FIG. 4 and the following figures, pin contacts 24, or pins, pass through the base 20 from one side to the other. The base 20 comprises a front part 22, a back part 21 and an intermediate wall 23. The back part 21 and the inner wall 23 are intended to be placed inside the electronics unit. The front part 22 is intended to be placed outside the electronics unit and to be connected to a complementary female plug. A nut 30 is provided to be screwed around the threading 25 made on the entire outer contour of the front part 22 of the base.

Thus, when the base is mounted in the wall of the electronics unit, the inner wall 23 is joined to said wall of the electronics unit. This wall is therefore tightened between the inner wall 23 and the nut 30 that is screwed on the front part 22 of the base. As shown in FIG. 4, after mounting the base in the wall of the electronics unit, said wall is placed in a space 15 provided between the inner wall 23 and the nut 30. Thus, once the nut 30 is in contact with the wall, the base 20 is held in fixed position in the orifice of the wall of the electronics unit.

According to the invention, the base 20 is equipped with a holding plate 40 mounted around the back part 21 of the base. This holding plate 40 is therefore positioned around pin contacts 24 to ensure that the base 20 is made integral with the printed circuit 50 of the electronics unit on which the pin contacts are connected.

Figure 6:
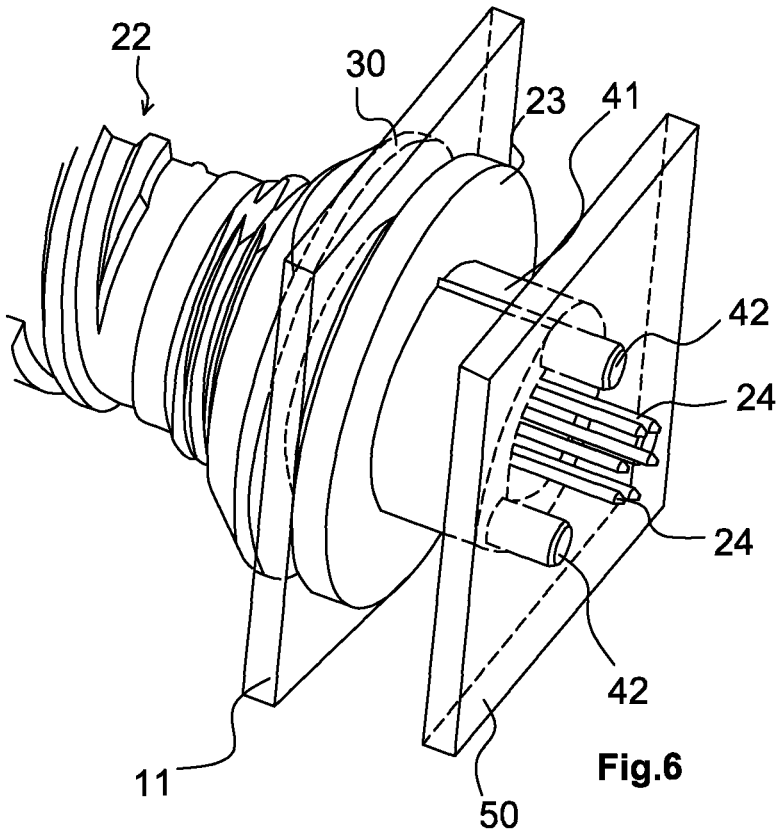
FIG. 6 shows a perspective view of the connection system of FIG. 4 when the pin contacts are connected to the printed circuit.

In fact, as shown in FIG. 6, the pin contacts 24 of the base 20 are welded on the printed circuit 50 so that an electrical connection is established between said pin contacts and said printed circuit. To ensure that the connection between the pin contacts 24 and the printed circuit 50 does not sustain any damage during the locking of the nut 30 around the base 20, the holding plate 40 of the invention has catch means 42. These catch means 42 are intended to be lodged in the printed circuit 50 to make the base 20 and the printed circuit integral.

More precisely, the holding plate 40 consists of a tubular element 41, or crown, comprising an outer cylindrical wall 41*a* and an inner cylindrical wall 41*b*, that is concentric with the outer cylindrical wall. This tubular element 41 has a shape and dimensions adapted to the contour of the back part 21 of the base. This tubular element 41 is equipped, on its circular face 45, with catch means 42.

These catch means 42 can be, for example, studs 42 that can be lodged in orifices of the printed circuit 50. These studs 42, once inserted into the printed circuit 50, make the base 20 integral with said printed circuit, which prevents any relative play between said base and said printed circuit. In the example shown in FIGS. 4 to 6, the studs are three in number and are distributed uniformly on the circular face 45 of the holding plate 40.

According to an embodiment of the invention, the outer cylindrical wall 41*a* is equipped with an orientation slot 46 that makes it possible for the operator to correctly orient the base with the holding plate so that the studs 42 are opposite the corresponding orifices of the printed circuit.

Figure 5A:
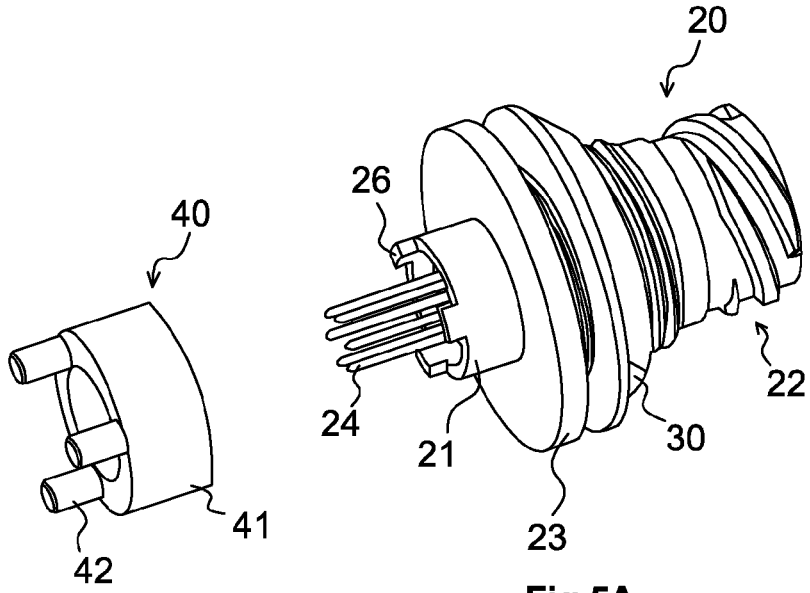
FIGS. 5A and 5B show two exploded views of the connection system of FIG. 4.
Figure 5B:
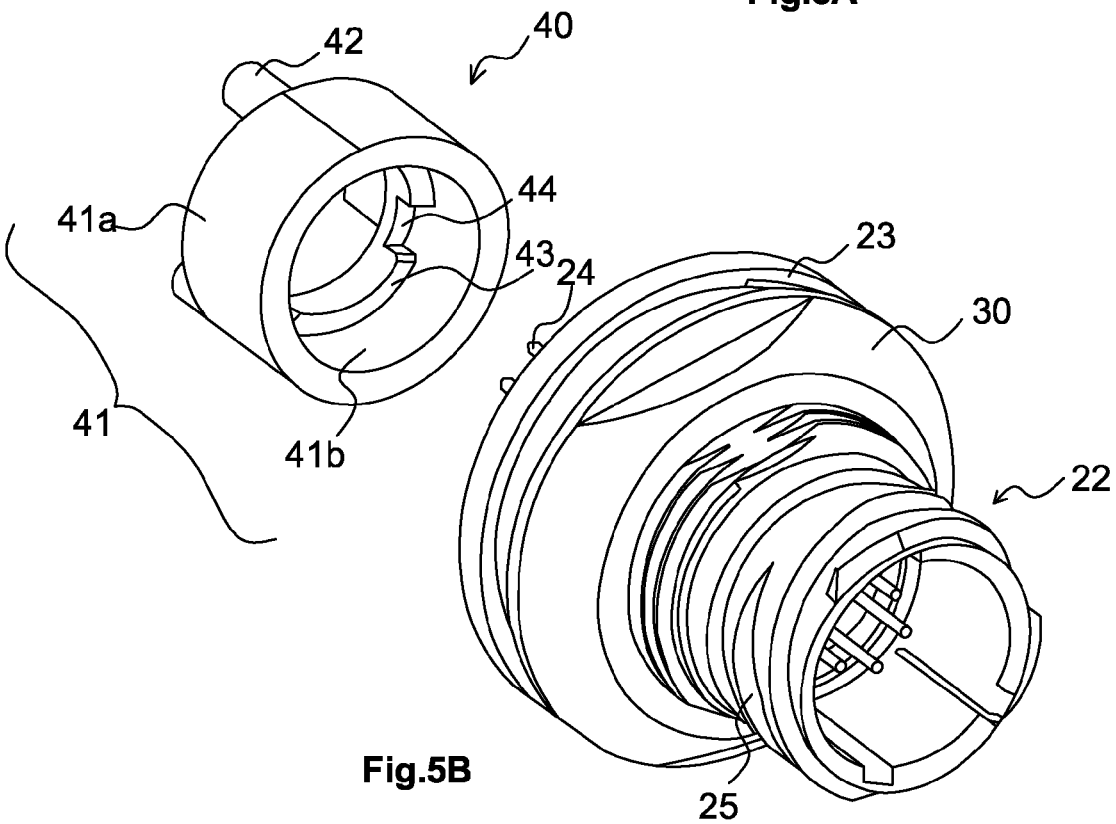

FIGS. 5A and 5B show an exploded view of the connection system of the invention, according to a side view and according to a front view, respectively. These FIGS. 5A and 5B therefore show the base 20 and the nut 30 screwed on the front part 22 of the base. They also show the pin contacts 24 passing through the base 20. A back end of these pin contacts 24 (that come out into the back part of the base) can be connected by welding to the printed circuit, while a front end of these pin contacts 24 (that come out into the front part of the base) can be connected to female contacts of a complementary plug not shown in the figures.

FIGS. 5A and 5B also show the holding plate 40 adapted to be fitted around the back part 21 of the base. As is shown more precisely in FIG. 5B, the holding plate 40 has its inner wall 41*b* equipped with one or more orientation notches 44. These orientation notches 44 each form a slot within a raised surface 43 made in the inner wall 41*b* of the holding plate 40. Each orientation notch 44 is provided to be fitted around a crenel 26 formed on the outer face of the back part 21 of the base. The whole unit consisting of the orientation notches 44 and the crenels 26 forms a fitting system that ensures the locking of the holding plate 40 around the back part 21 of the base and thus prevents any rotation of the base relative to the holding plate.

It is deduced from the preceding that an operator who wants to connect a base onto a printed circuit with the connection system of the invention must perform the following operations:

he must first of all install the holding plate around the back part of the base by causing the orientation notches 44 of the holding plate to line up with the crenels 26 of the back part 21 of the base;

he must then introduce the pin contacts 24 of the base and the studs 42 of the holding plate into the printed circuit 50 and weld the pin contacts onto the printed circuit to ensure their electrical connection;

he can then mount the front part 22 of the base in an orifice 12 of the wall 11 of the electronics unit and screw a nut 30 around the threading 25 of the front part 22 of the base until the wall is tightened between said nut 30 and the inner wall 23 of the base.

From the preceding description, it is understood that the possible movements of rotation produced by the screwing of the nut 30 around the base 20 are of no consequence to the connection of the pin contacts 24 in the printed circuit 50. In fact, since the holding plate 40 is fixed in the printed circuit and the base is integral with said holding plate, the base is made integral with the printed circuit. Also, regardless of the movements of rotation produced by the nut 30 on the base 20, no relative rotation is possible between the base 20 and the printed circuit 50. The tightening of the nut 30 on the base, even if it causes a movement of the base, does not induce any relative movement of the base in relation to the printed circuit. The connection made by welding the pin contacts 24 onto the printed circuit is therefore maintained.

The holding plate as a whole, which has just been described, can be made from a thermoplastic material, or any other material that is easy to mold. The holding plate can be, for example, molded of PEEK (polyether ether ketone), a material that has the advantage of having a very good temperature stability and good electrical insulation properties.

Moreover, since the holding plate according to the invention is made in the form of an added part, adapted to the shape of the back part of the base, it can be used with standard base bodies. The connection system of the invention can therefore be put in place on existing bases. No inherent modification of the base is necessary, which makes it possible to avoid costs connected with a modification of said base.

The invention claimed is:

1. A connection system, comprising:

a base (20) that is mountable through a wall (11) of an electronics unit (10), said base (20) including electric pin contacts (24) that extend out into the electronics unit and have ends that are connected electrically to a printed circuit (50) of said electronics unit, the base (20) being equipped with a holding plate (40) that is mounted around electric pin contacts (24) and around a back part (21) of the base, and provided with catch means (42) that can be fitted into the printed circuit, such that the base is integral with the printed circuit, the holding plate (40) comprising, on an inner cylindrical wall (41*b*), orientation notches (44) that can prevent any relative movement of rotation between the holding plate and the base.

2. The connection system according to claim 1, wherein the holding plate (40) is made by molding a thermoplastic material.

3. The connection system according to claim 1, further comprising:

a nut (30) that can be screwed around a front part (22) of the base and that can be tightened against the wall (11) of the electronics unit.

4. A process for mounting the connection system according to claim 1, comprising:

mounting the holding plate (40) around the back part (21) of the base (20);

mounting the electric pin contacts (24) of the base and of the catch means (42) of the holding plate in the printed circuit;

connection of the electric pin contacts (24) on the printed circuit (50);

mounting the front part (22) of the base in an orifice (12) of the wall (11) of the electronics unit; and screwing a nut (30) around the front part (22) of the base until the wall is tightened.

5. The connection system according to claim 1, where the holding plate (40) exhibits a cylindrical shape with dimensions suitable for the contour of the back part (21) of the base.

6. The connection system according to claim 5, wherein the catch means comprise at least two studs (42) that are distributed on a circular face (45) of the holding plate (40) and that can be lodged in the printed circuit.

7. The connection system according to claim 5, wherein the holding plate (40) is made by molding a thermoplastic material.

8. The connection system according to claim 1, wherein the catch means comprise at least two studs (42) that are distributed on a circular face (45) of the holding plate (40) and that can be lodged in the printed circuit.

9. The connection system according to claim 8, wherein the holding plate (40) is made by molding a thermoplastic material.

* * * * *